US012727622B2

(12) United States Patent
Sun et al.

(10) Patent No.: US 12,727,622 B2
(45) Date of Patent: Sep. 8, 2026

(54) AEROSOL GENERATION DEVICE, DRY BURNING DETECTION METHOD, AND COMPUTER PROGRAM PRODUCT

(71) Applicant: SHENZHEN SMOORE TECHNOLOGY LIMITED, Shenzhen (CN)

(72) Inventors: Changwen Sun, Shenzhen (CN); Weiming Fang, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 427 days.

(21) Appl. No.: 18/465,609

(22) Filed: Sep. 12, 2023

(65) Prior Publication Data

US 2023/0413920 A1 Dec. 28, 2023

Related U.S. Application Data

(63) Continuation of application No. PCT/CN2021/081200, filed on Mar. 17, 2021.

(51) Int. Cl.

| | |
|---|---|
| ***A24F 47/00*** | (2020.01) |
| ***A24F 40/46*** | (2020.01) |
| ***A24F 40/53*** | (2020.01) |
| ***A24F 40/57*** | (2020.01) |
| *A24F 40/51* | (2020.01) |

(52) U.S. Cl.

CPC ..... *A24F 40/53* (2020.01); *A24F 40/46* (2020.01); *A24F 40/57* (2020.01); *A24F 40/51* (2020.01)

(58) Field of Classification Search

CPC ..... A24F 40/50; A24F 40/53; A24F 40/57

See application file for complete search history.

(56) References Cited

U.S. PATENT DOCUMENTS

2019/0166918 A1* 6/2019 Thorsen ..... A24F 40/50
2022/0192273 A1* 6/2022 Yan ..... A24F 40/57

FOREIGN PATENT DOCUMENTS

CN 108966390 A 12/2018
CN 109330032 A 2/2019

(Continued)

OTHER PUBLICATIONS

CN109588779 Translation (Year: 2019).*

(Continued)

*Primary Examiner* — Eric Yaary
(74) *Attorney, Agent, or Firm* — Leydig, Voit & Mayer, Ltd.

(57) ABSTRACT

An aerosol generation device includes: a heater having at least one heating element for heating an aerosol-forming substrate; a power supply; and a circuit, connected to the heater and the power supply, the circuit: obtaining a sampling value of a thermal property of the at least one heating element in real time; when the sampling value exceeds a preset determining threshold, controlling power supplied by the power supply to the at least one heating element to stabilize the sampling value of the thermal property of the at least one heating element to a target value; obtaining an output power of the at least one heating element; and issuing a prompt when the output power is less than a preset power threshold to prompt a user that dry burning occurs in the at least one heating element.

20 Claims, 7 Drawing Sheets

(56) References Cited

FOREIGN PATENT DOCUMENTS

| | | | | | |
|---|---|---|---|---|---|
| CN | 109475191 | A | | 3/2019 | |
| CN | 109588779 | A | * | 4/2019 | ..... A24F 47/008 |
| CN | 109805451 | A | | 5/2019 | |
| CN | 110487848 | A | | 11/2019 | |
| CN | 110584204 | A | | 12/2019 | |
| CN | 111000294 | A | | 4/2020 | |
| CN | 111165914 | A | | 5/2020 | |
| CN | 112107035 | A | | 12/2020 | |
| CN | 112189907 | A | | 1/2021 | |
| CN | 112353009 | A | | 2/2021 | |
| CN | 110558617 | B | | 12/2022 | |
| CN | 110584204 | B | | 6/2023 | |
| EP | 3711566 | A1 | | 9/2020 | |
| WO | 2015143648 | A1 | | 10/2015 | |

OTHER PUBLICATIONS

Patent Cooperation Treaty, International Search Report and Written Opinion, International Application No. PCT/CN2021/081200 (Dec. 22, 2021).

Chinese Patent Office, Office Action in Chinese Patent Application No. 202110283696.3 (May 5, 2023).

Chinese Patent Office, Rejection Decision in Chinese Patent Application No. 202110283696.3 (Mar. 4, 2024).

Lu Xu, "Temperature control principle and use of constant temperature bath," Physical and Chemistry Experiments, China Medical Science and Technology Press, pp. 8 (Mar. 2020).

Sheng et al., "12365 Hotline Complaint Case Inventory," Shanghai quality, vol. 6, pp. 72 (Dec. 2008).

* cited by examiner

AEROSOL GENERATION DEVICE, DRY BURNING DETECTION METHOD, AND COMPUTER PROGRAM PRODUCT

CROSS-REFERENCE TO PRIOR APPLICATION

This application is a continuation of International Patent Application No. PCT/CN2021/081200, filed on Mar. 17, 2021. The entire disclosure is hereby incorporated by reference herein.

FIELD

This application relates to an aerosol generation device, a dry burning detection method, and a computer program product.

BACKGROUND

With the development of vaporization technologies, an aerosol vaporization technology emerges, using a heating element to heat an aerosol-forming substrate to achieve vaporization and generate aerosol.

However, the inventor realizes that dry burning needs to be avoided in a process of using an aerosol vaporization device. Further heating of the aerosol vaporization device in case of a lack of aerosol-forming substrates leads to a temperature surge in the heating element, causing dry burning. At this time, harmful substances and burnt smell are produced, affecting normal use and even effecting personal health of users. Therefore, to effectively avoid causing health risks to the users, the occurrence of dry burning need to be detected in a timely manner.

SUMMARY

In an embodiment, the present invention provides an aerosol generation device, comprising: a heater comprising at least one heating element configured to heat an aerosol-forming substrate; a power supply; and a circuit, connected to the heater and the power supply, the circuit being configured to: obtain a sampling value of a thermal property of the at least one heating element in real time; when the sampling value exceeds a preset determining threshold, control power supplied by the power supply to the at least one heating element to stabilize the sampling value of the thermal property of the at least one heating element to a target value; obtain an output power of the at least one heating element; and issue a prompt when the output power is less than a preset power threshold to prompt a user that dry burning occurs in the at least one heating element.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
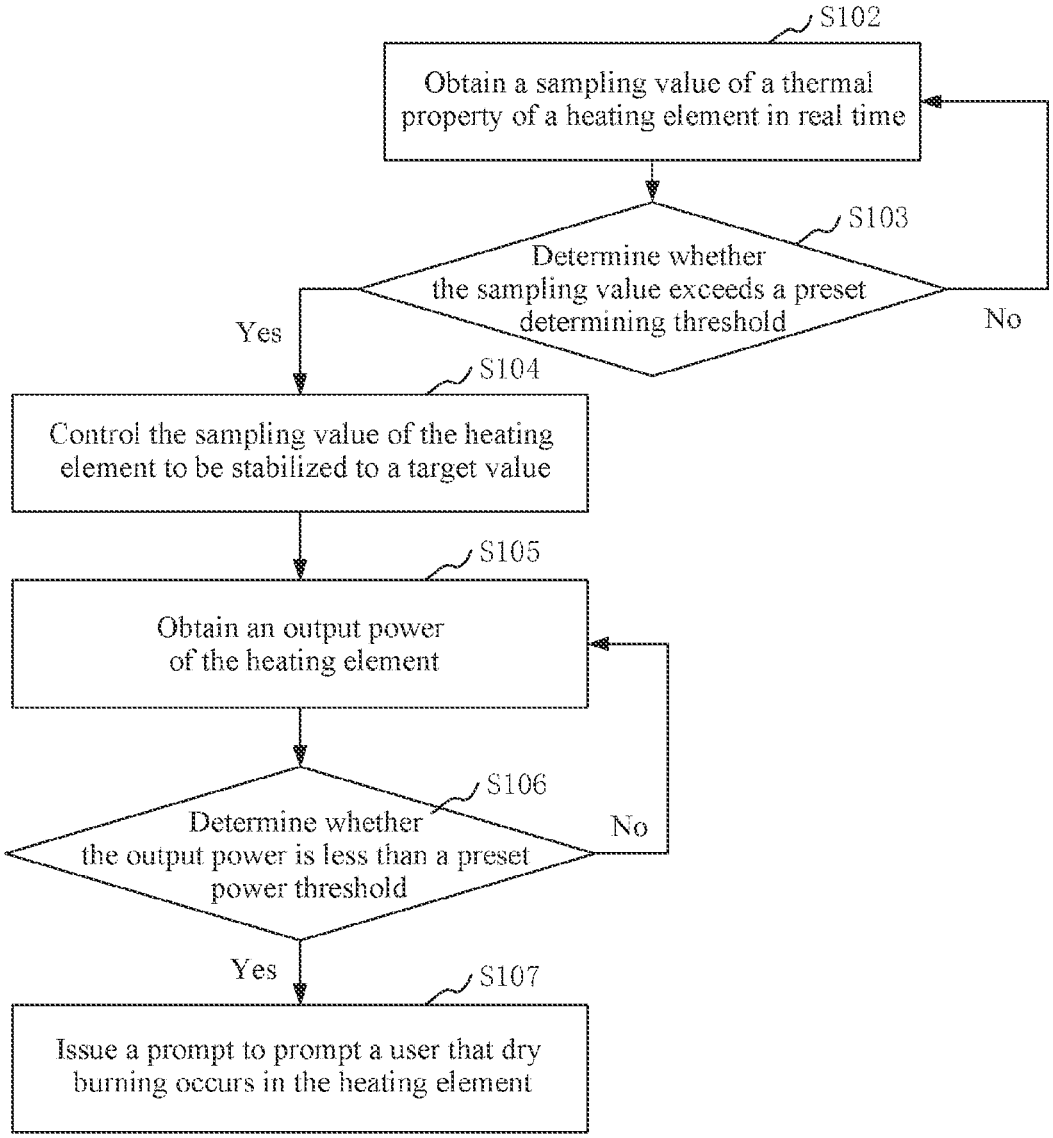
FIG. 1 is a first schematic flowchart of a dry burning detection method according to an embodiment.

In an embodiment, the present invention provides, an aerosol generation device, a dry burning detection method, and a computer program product are provided.

In an embodiment, the present invention provides an aerosol generation device, including:

- a heater, including at least one heating element configured to heat an aerosol-forming substrate;
- a power supply; and
- a circuit, connected to the heater and the power supply, where the circuit is configured to:
- obtain a sampling value of a thermal property of the heating element in real time;
- when the sampling value exceeds a preset determining threshold, control power supplied by the power supply to the heating element to stabilize the sampling value of the thermal property of the heating element to a target value;
- obtain an output power of the heating element; and
- issue a prompt when the output power is less than a preset power threshold to prompt a user that dry burning occurs in the heating element.

A dry burning detection method is provided, including:

- obtaining a sampling value of a thermal property of a heating element in real time;
- when the sampling value exceeds a preset determining threshold, controlling the sampling value of the thermal property of the heating element to be stabilized to a target value;
- obtaining an output power of the heating element; and
- issuing a prompt when the output power is less than a preset power threshold to prompt a user that dry burning occurs in the heating element.

A computer program product is provided, including one or more computer-readable storage mediums storing computer-readable instructions, where the computer-readable instructions, when executed by one or more processors, cause the one or more processors to perform the following steps:

- obtaining a sampling value of a thermal property of a heating element in real time;
- when the sampling value exceeds a preset determining threshold, controlling the sampling value of the thermal property of the heating element to be stabilized to a target value;
- obtaining an output power of the heating element; and issuing a prompt when the output power is less than a preset power threshold to prompt a user that dry burning occurs in the heating element.

For ease of understanding of this application, to make the features and advantages of this application clearer and more comprehensible, detailed description is made to specific implementations of this application below with reference to the accompanying drawings. Many specific details are provided in the following description to help fully understand this application, and preferred embodiments of this application are illustrated in the accompanying drawings. However, this application may be implemented in many different forms, and is not limited to the implementations described herein. On the contrary, the implementations are provided to make the understanding of the disclosed content of this application more thorough and comprehensive. This application may be implemented in many other manners different from those described herein. A person skilled in the art can make similar improvements without departing from the connotation of this application. Therefore, this application is not limited to the specific embodiments disclosed below.

In addition, terms "first" and "second" are used merely for the purpose of description, and should not be construed as indicating or implying relative importance or implicitly indicating a quantity of indicated technical features. Therefore, features defined by "first" or "second" may explicitly or implicitly include at least one of such features. In description of this application, "multiple" means at least two, such as two and three unless it is specifically defined otherwise.

It should be noted that, when an element is considered to be "connected to" another element, the element may be connected to the another element directly or through an intermediate element. In addition, "connected" in the following embodiments is to be interpreted as "electrically connected", "communicatively connected", or the like if the connected objects have electrical signals or data transmission between each other.

When used herein, the singular forms of "a", "an" and "the/this" may also include plural forms, unless otherwise clearly indicated. It should also be understood that the terms such as "including/comprising" and "having" indicate the existence of the stated features, wholes, steps, operations, components, parts or combinations thereof. However, these terms do not exclude the possibility of the existence of one or more other features, wholes, steps, operations, components, parts or combinations thereof. In addition, the term "and/or" used in this specification includes any and all combinations of related listed items.

In an embodiment, as shown in FIG. 1, a dry burning detection method is provided, applied to an aerosol generation device. The aerosol generation device includes: a heater, a power supply, and a circuit. The heater includes at least one heating element configured to heat an aerosol-forming substrate. The circuit is connected to the heater and the power supply. The dry burning detection method includes:

Step S102. Obtain a sampling value of a thermal property of the heating element in real time.

The heating element is configured to heat an aerosol-forming substrate to generate aerosol. The sampling value of the thermal property of the heating element may be a resistance sampling value or a temperature sampling value of the heating element at an arbitrary moment during heating. Specifically, the obtaining of the sampling value may start upon receipt of a heating trigger signal. Specifically, the aerosol generation device may be an e-cigarette or a medical nebulizer. The heating trigger signal may be a trigger signal input by a user through an input component, for example, through a pushbutton switch or a touchscreen. For an e-cigarette, a suction action of a user may be detected by an airflow detection sensor as a heating trigger signal.

Step S103. Determine whether the sampling value exceeds a preset determining threshold.

The determining threshold is used for determining whether a temperature surge occurs in the heating element. If the sampling value does not exceed the determining threshold, it is determined that no temperature surge occurs in the heating element. In this case, step S102 is performed, until a collected sampling value exceeds the determining threshold, and then step S104 is performed.

Step S104. When the sampling value exceeds the preset determining threshold, control the sampling value of the heating element to be stabilized to a target value.

If the sampling value exceeds the determining threshold, it is determined that a temperature surge occurs in the heating element. In this case, dry burning may occur, and a heating temperature of the heating element needs to be adjusted to make the heating temperature constant. Specifically, the adjustment may be implemented through a PID algorithm, to stabilize the sampling value of the thermal property of the heating element at a set target value.

Step S105. Obtain an output power of the heating element.

The output power of the heating element is obtained when the sampling value of the thermal property of the heating element is stabilized at the target value. According to the energy conservation law, during heating at a constant temperature, part of the output power of the heating element is used for heating the aerosol-forming substrate, and part of the output power is used for heat absorption by the heating element. If the aerosol-forming substrate is reduced, the output power is also reduced. Therefore, it can be determined according to the output power at this time whether there is a lack of aerosol-forming substrate.

Step S106. Determine whether the output power is less than a preset power threshold. When the output power is not less than the power threshold, return to step S105.

Step S107. Issue a prompt when the output power is less than the preset power threshold to prompt a user that dry burning occurs in the heating element.

If the output power is less than the power threshold, there is a lack of aerosol-forming substrate at this time, that is, dry burning occurs. In this case, a dry burning protection program for the aerosol-forming substrate may be triggered, such as stopping heating and/or issuing an alarm prompt.

It should be noted that, the dry burning mentioned in this embodiment of this application may refer to dry burning that occurs when there is completely no aerosol-forming substrate, or dry burning that occurs when the content of the aerosol-forming substrate is relatively low and normal use cannot be continued.

According to the dry burning detection method, the sampling value of the thermal property of the heating element is obtained in real time; it is determined whether the sampling value exceeds the preset determining threshold, and if yes, the sampling value of the heating element is controlled to be stabilized to the target value, and the output power of the heating element at this time is obtained; and if the output power is less than the preset power threshold, it is determined that dry burning occurs in the heating element, and a dry burning prompt is issued. The energy conservation law is used to determine whether dry burning occurs in the heating element. The detection is simply and the accuracy is high. The inventor found through research that, the temperature of the heating element gradually stabilizes in a normal heating process, reaching the thermal balance state. If the heating element dries out due to insufficient aerosol-forming substrates, the heating element generally cannot reach the thermal balance state. In this case, a temperature surge occurs in the heating element within a particular period of time, that is, the sampling value exceeds the determining threshold within this period of time. However, the temperature surge may alternatively be caused by reasons other than the lack of aerosol-forming substrates for a short period of time. After further heating for a period of time, the reason for the temperature surge disappears, and the temperature gradually returns to normal, and the thermal balance state is achieved. Failure to differentiate may lead to inaccurate determining, affecting normal use of the aerosol generation device.

Figure 2:
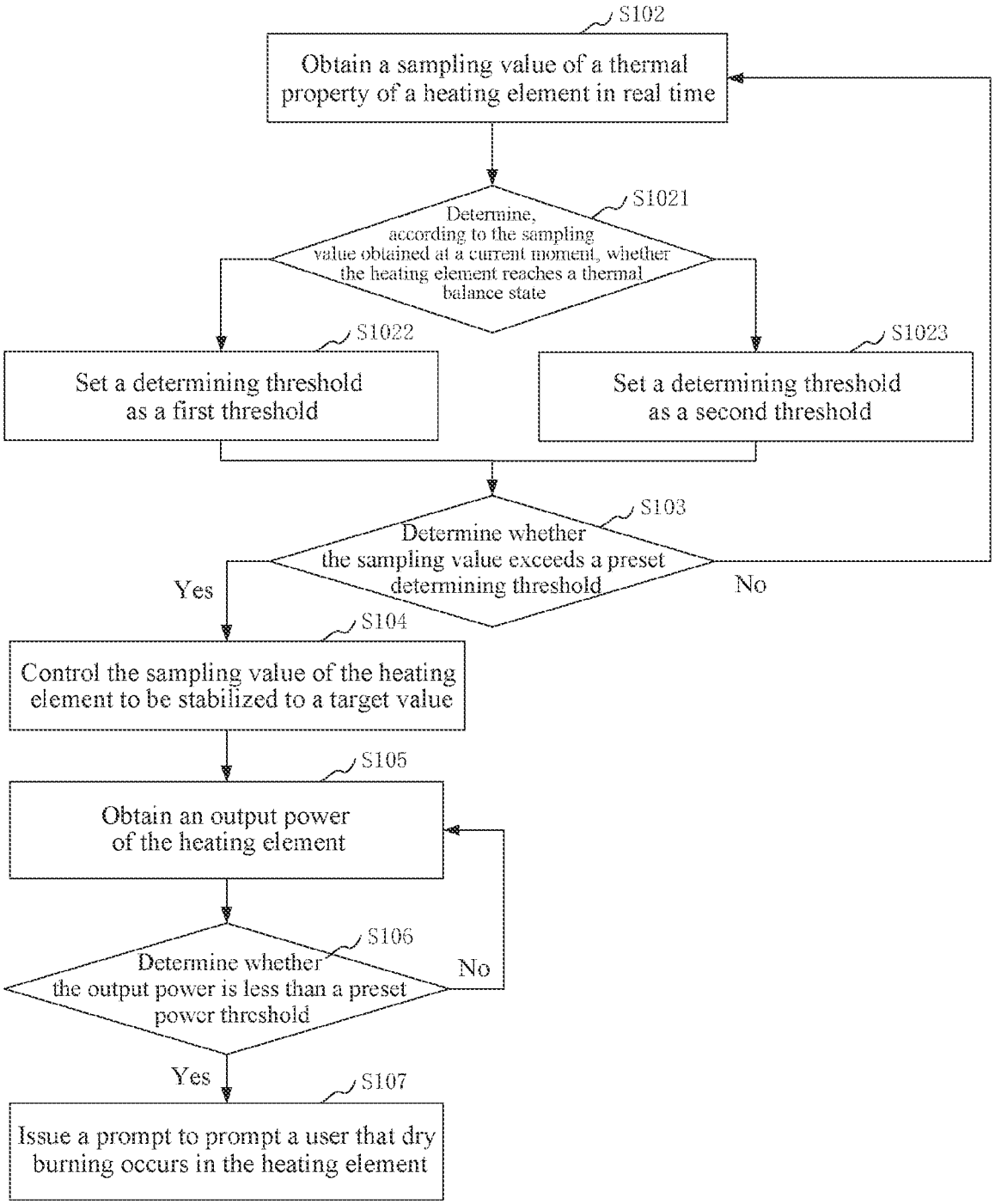
FIG. 2 is a second schematic flowchart of a dry burning detection method according to an embodiment.

To eliminate the foregoing effect and avoid inaccurate determining, in an embodiment, as shown in FIG. 2, after the step of obtaining a sampling value of a thermal property of the heating element, the method further includes:

Step S1021. Determine, according to the sampling value obtained at a current moment, whether the heating element reaches a thermal balance state.

Step S1022. Set the determining threshold as a first threshold if the heating element reaches the thermal balance state, where the first threshold is greater than a thermal balance stabilization value, and the thermal balance stabilization value is a thermal property value of the heating element in the thermal balance state.

The thermal balance stabilization value may be a thermal property sampling value when the heating element enters the thermal balance state in the current heating process.

Step S1023. Set the determining threshold as a second threshold if the heating element does not reach the thermal balance state, where the second threshold is a thermal property maximum value of the heating element, and the thermal property maximum value is a thermal property value of the heating element at a preset maximum safety temperature.

If the thermal property value is a resistance value, the thermal property maximum value may be calculated according to an initial sampling value and the preset maximum safety temperature of the heating element. If the thermal property value is a temperature value, the thermal property maximum value is the preset maximum safety temperature.

In this embodiment, it is first determined whether the heating element reaches the thermal balance state, and then the determining threshold is set according to a determining result. In this way, the reason for inaccurate determining is eliminated, thereby improving accuracy of dry burning detection.

Figure 3:
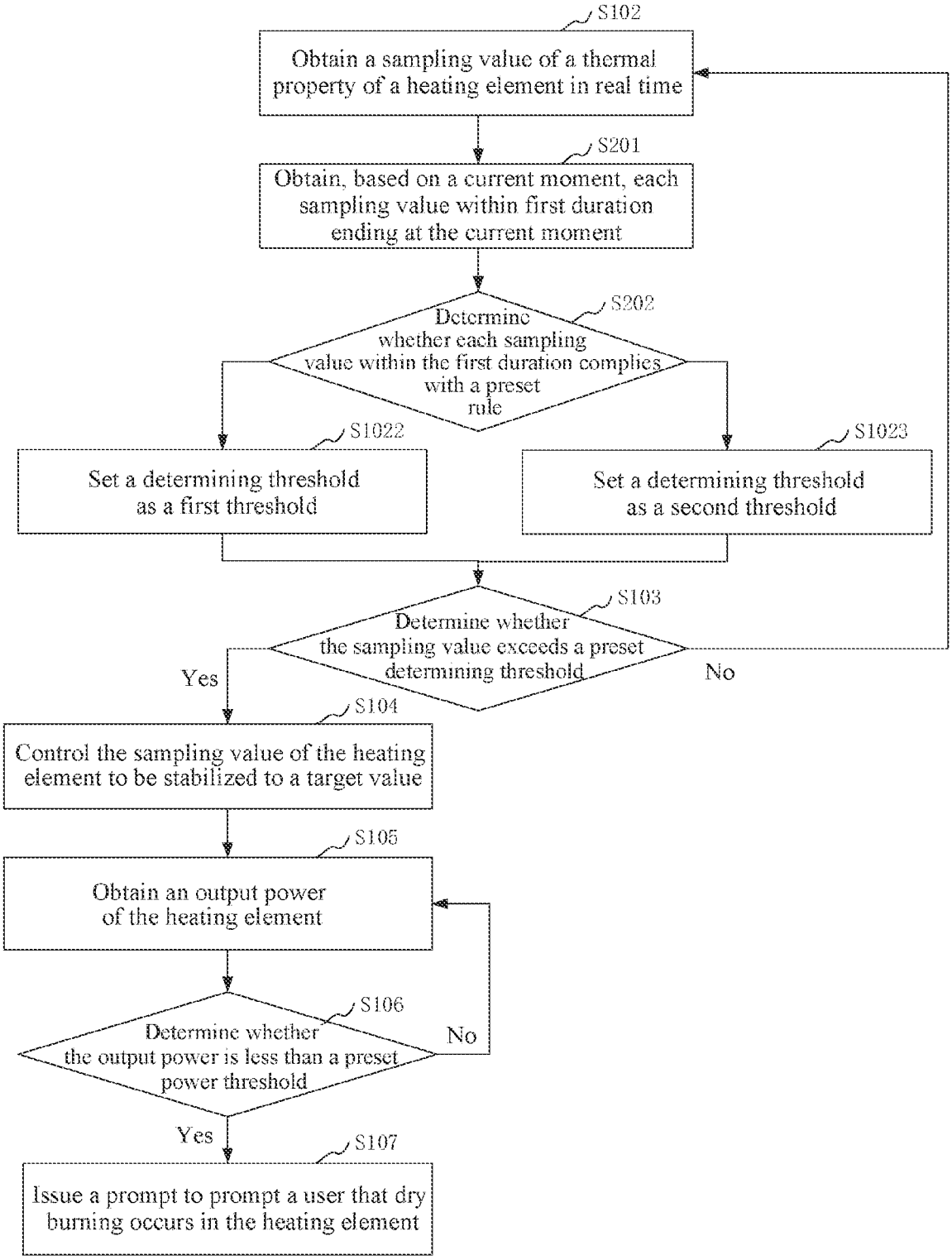
FIG. 3 is a third schematic flowchart of a dry burning detection method according to an embodiment.

In an embodiment, as shown in FIG. 3, the determining whether the heating element reaches a thermal balance state includes the following steps: Step S201. Obtain, based on the current moment, each sampling value within first duration ending at the current moment, where the first duration includes the current moment.

Step S202. Determine whether each sampling value within the first duration complies with a preset rule. If no, return to step S102. If each sampling value within the first duration complies with the preset rule, determine that the heating element reaches the thermal balance state. In an embodiment, the preset rule is: a difference between the largest value and the smallest value among the sampling values within the first duration falls within a preset difference range.

The difference range refers to an allowable fluctuation range of the resistance sampling value when the heating element is in the thermal balance state. It can be determined that the heating element is in the thermal balance state according to whether the difference falls within the difference range. For example, the current moment is 19:05:10:620, and the aerosol generation device obtains a sampling value of the thermal property of the heating element every 200 milliseconds. In this case, the first duration may be an integer multiple of 200 milliseconds, such as 600 milliseconds. In this case, from 19:05:10:20 to 19:05:10:620, four sampling values can be obtained, where the largest value is 580 and the smallest value is 578. If the preset difference range is 10, the difference between the largest value and the smallest value among the sampling values within the first duration falls within the preset difference range. In this case, it can be determined that the heating element reaches thermal balance.

In an embodiment, the preset rule may be that all the sampling values within the first duration are the same. For example, the current moment is 19:05:10:620, and the aerosol generation device obtains a sampling value of the thermal property of the heating element every 200 milliseconds. In this case, the first duration may be an integer multiple of 200 milliseconds, such as 600 milliseconds. In this case, from 19:05:10:20 to 19:05:10:620, four sampling values can be obtained. When the four sampling values are the same, it can be determined that the heating element reaches thermal balance.

In another embodiment, the preset rule may alternatively be each sampling value difference within the first duration falls within a preset range. For example, the current moment is 19:05:10:620, the aerosol generation device obtains the sampling value of the thermal property of the heating element every 200 milliseconds, and the first duration may be an integer multiple of 200 milliseconds, such as 600 milliseconds. In this case, from 19:05:10:20 to 19:05:10:620, four sampling values can be obtained, which are respectively 578, 579, 580, and 578. If the preset range is 10, each sampling value difference within the first duration falls within the preset range. In this case, it can be determined that the heating element reaches thermal balance.

Figure 5:
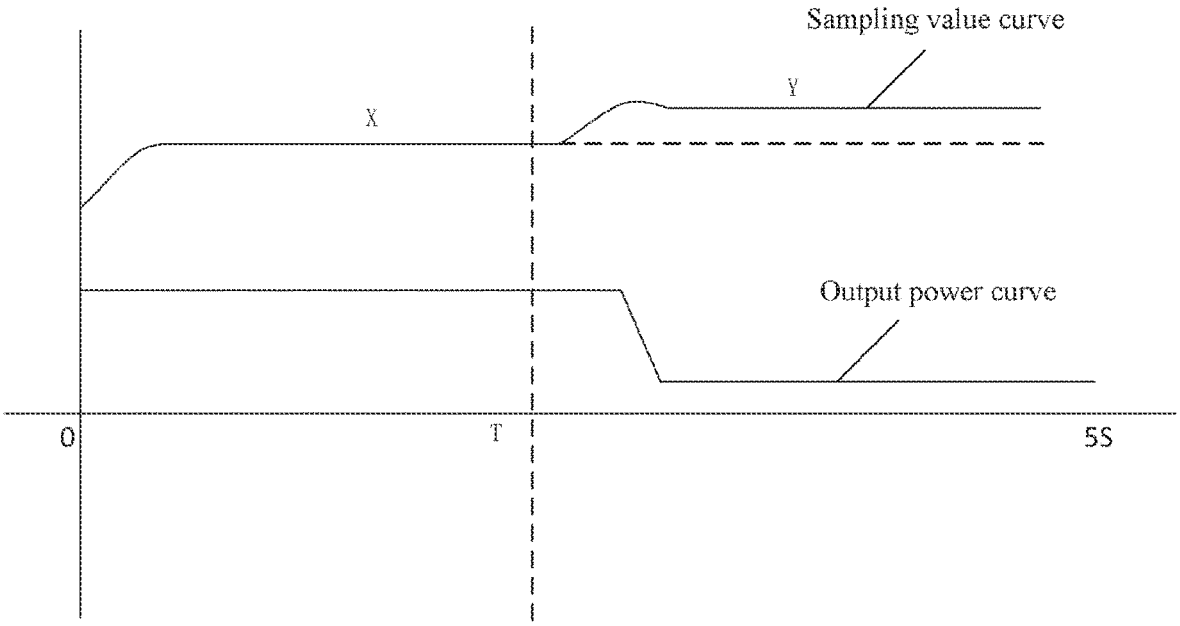
FIG. 5 is a line graph of a resistance sampling value and an output power of a heating element according to an embodiment.

In an embodiment, as shown in FIG. 5, when the sampling value exceeds the preset determining threshold, the method further includes:

Step S1031. Obtain a heating time corresponding to when the sampling value exceeds the determining threshold.

When a sampling value obtained at a moment exceeds the determining threshold, a currently corresponding heating time is obtained. Specifically, the heating time may refer to this time point, that is, a moment, or duration from the beginning of the heating to this moment, that is, a time period.

Further, a preset continuous heating time may be used to distinguish a reason that causes the temperature surge in the heating element, and then an appropriate target value is selected to achieve constant temperature control with the PID algorithm.

Figure 4:
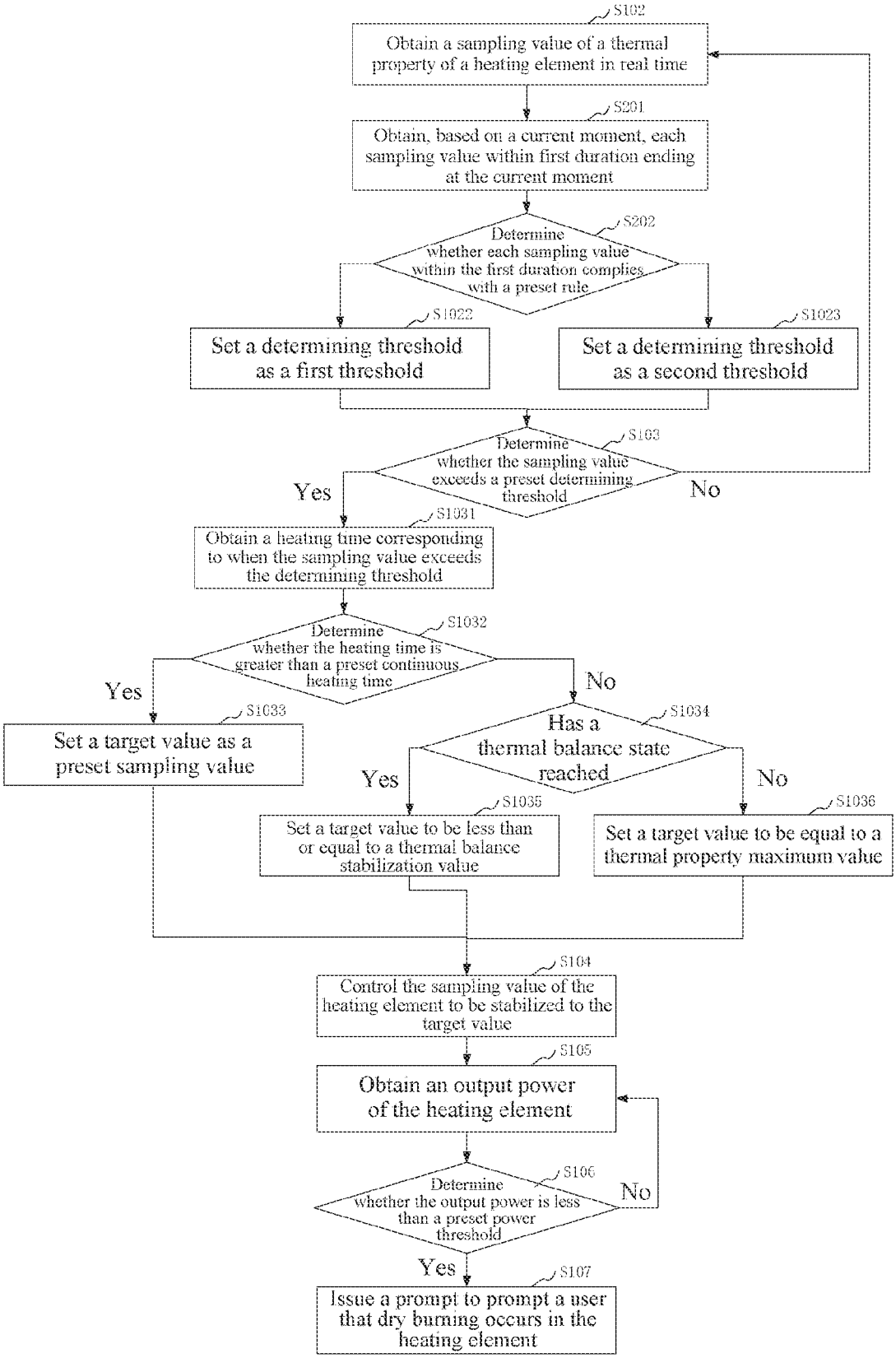
FIG. 4 is a fourth schematic flowchart of a dry burning detection method according to an embodiment.

As shown in FIG. 4, in an embodiment, referring to a line graph shown in FIG. 5, the method further includes: Step S1032. Determine whether the heating time is greater than a preset continuous heating time.

Step S1033. If the heating time is greater than the preset continuous heating time, the target value is a preset sampling value, and the preset sampling value is greater than the thermal balance stabilization value. In FIG. 5, X represents the thermal balance stabilization value, Y represents the target value, and T represents the continuous heating time.

If the case that the sampling value exceeds the determining threshold occurs after the continuous heating time, the target value can be selected as the preset sampling value. The preset sampling value is greater than the thermal balance stabilization value, that is, when the target value of the heating element is selected as the preset sampling value, the temperature of the heating element is higher than a temperature in the thermal balance state during normal operation, thereby eliminating the problem of short-term temperature surges and allowing the heating element to quickly return to normal operation. If the temperature surge is not caused by the lack of aerosol-forming substrates, the output power of the heating element also remains at a normal level after the heating is controlled at a constant temperature based on the preset sampling value for a period of time, that is, the output power is not less than the power threshold, thereby avoiding inaccurate determining.

Figure 6:
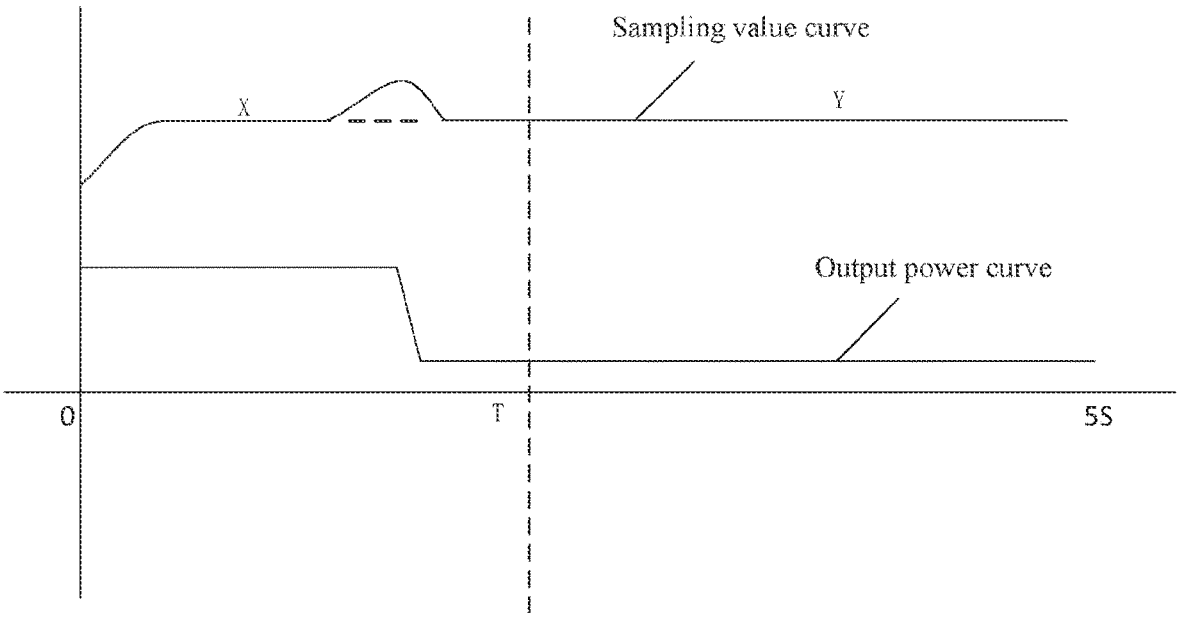
FIG. 6 is a line graph of a resistance sampling value and an output power of a heating element according to another embodiment.

As shown in FIG. 4, in an embodiment, referring to a line graph shown in FIG. 6, the method further includes:

Step S1034. Determine whether the heating element has reached the thermal balance state.

Step S1035. If the heating time is less than a preset continuous heating time and the heating element has reached the thermal balance state, the target value is less than or equal to the thermal balance stabilization value.

The thermal balance stabilization value may be the latest recorded thermal balance stabilization value of the heating element in the thermal balance state, that is, it may be the thermal balance stabilization value recorded when the thermal balance state is reached during the current heating process. The target value may be less than a preset floating-down value of the thermal balance stabilization value, or may be equal to the thermal balance stabilization value. In FIG. 6, X represents the thermal balance stabilization value, Y represents the target value, and T represents the continuous heating time.

If the case that the sampling value exceeds the determining threshold occurs before the continuous heating time, the target value can be selected as the thermal balance stabilization value or floated down to the preset floating-down value of the thermal balance stabilization value to, so that the heating element can work at a safety heating temperature and the temperature does not continue to increase above the maximum safety temperature. In this case, whether the aerosol-forming substrate is insufficient, that is, whether dry burning occurs, can be accurately and safely determined according to whether the output power is less than the power threshold.

Figure 7:
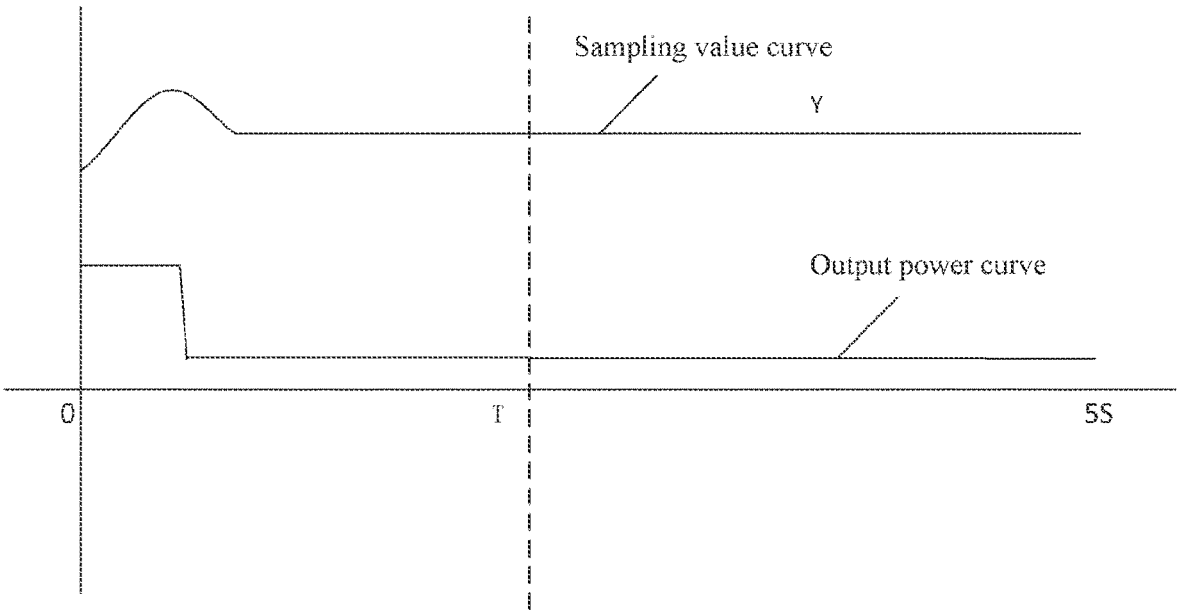
FIG. 7 is a line graph of a resistance sampling value and an output power of a heating element according to still another embodiment.

As shown in FIG. 4, in an embodiment, referring to a line graph shown in FIG. 7, the method further includes:

Step S1036. If the heating time is less than the preset continuous heating time and the heating element has not reached the thermal balance state, the target value is equal to the thermal property maximum value. In FIG. 7, X represents the thermal balance stabilization value, Y represents the target value, and T represents the continuous heating time.

The thermal balance stabilization value when the heating element reaches the thermal balance state in a case that the aerosol-forming substrate is sufficient is generally smaller than the thermal property maximum value. However, with repeated heating, the initial sampling value of the heating element may gradually change, such as gradually increasing. In this case, the thermal balance stabilization value also gradually increases accordingly, and gradually approaches the thermal property maximum value, or even exceeds the thermal property maximum value. Consequently, inaccurate determining is caused at this time. If the case that the sampling value exceeds the determining threshold occurs before the continuous heating time, and the heating element has not reached the thermal balance state during the current heating process, the thermal balance stabilization value can be selected as the target value or the thermal property maximum value is directly used as the target value for temperature control, to determine whether the output power of the heating element is less than the power threshold under the target value, thereby improving the accuracy of dry burning detection.

Figure 8:
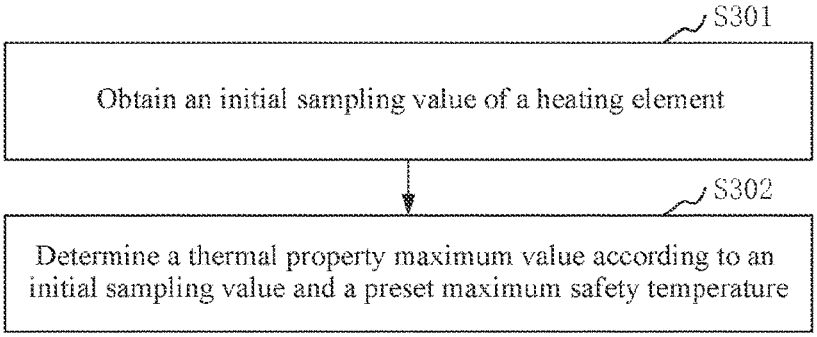
FIG. 8 is a schematic flowchart of a step of determining a thermal property maximum value according to an embodiment.

In an embodiment, as shown in FIG. 8, the dry burning detection method further includes: Step S301. Obtain an initial sampling value of the heating element.

The initial sampling value refers to a sampling value of the thermal property of the heating element at a normal temperature, or may be understood as a sampling value before the heating is started. In this embodiment, The sampling value can be understood as a resistance value.

Step S302. Determine a thermal property maximum value according to the initial sampling value and a preset maximum safety temperature.

In this embodiment, The thermal property maximum value is the resistance value of the heating element at the maximum safety temperature. During determining of the maximum safety temperature, the thermal property maximum value can be determined according to a resistance temperature coefficient of the heating element. The formula is as follows:

$$S_{top}=S_0+K_{tcr}*(T_{top}-T_0)$$

where S to p is the thermal property maximum value, $S_0$ is the initial sampling value, $K_{tcr}$ is the resistance temperature coefficient of the heating element, $T_{top}$ is the maximum safety temperature, and $T_0$ is the normal temperature (for example, the normal temperature can be 25° C.).

It should be understood that although the steps of the flowcharts in FIG. 1 to FIG. 4 and FIG. 8 are shown sequentially according to arrows, the steps are not necessarily performed according to a sequence indicated by the arrows. Unless otherwise explicitly specified in this application, execution of the steps is not strictly limited, and the steps may be performed in other sequences. In addition, at least some of the steps in FIG. 1 to FIG. 4 and FIG. 8 may include multiple sub-steps or stages. These sub-steps or stages are not necessarily performed at the same moment, but may be performed at different moments. The sub-steps or stages are not necessarily performed in sequence, but may be performed alternately with other steps or at least some of sub-steps or stages of other steps.

Figure 9:
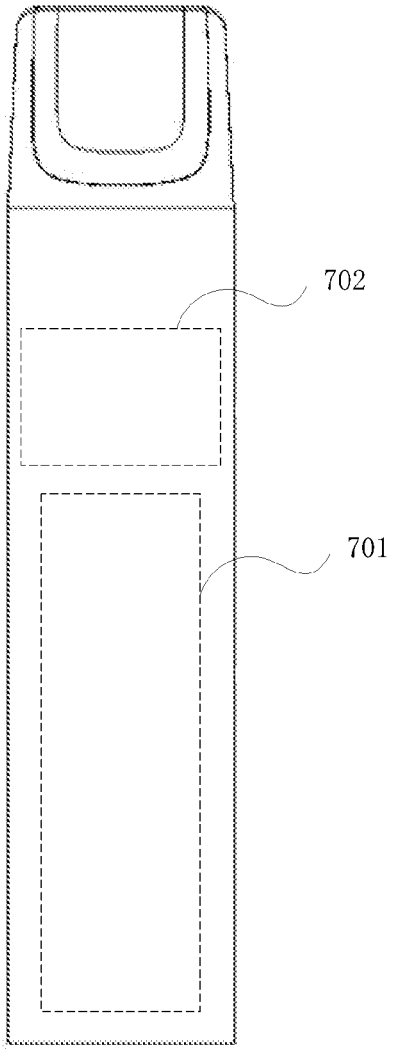
FIG. 9 is a schematic structural diagram of an aerosol generation device according to an embodiment.

In an embodiment, as shown in FIG. 9, an aerosol generation device is provided, including: a heater 701, a power supply, and a circuit 702. The heater 701 includes at least one heating element configured to heat an aerosol-forming substrate. The circuit 702 is connected to the heater 701 and the power supply. The circuit 702 is configured to:

- obtain a sampling value of a thermal property of the heating element in real time;
- when the sampling value exceeds a preset determining threshold, control power supplied by the power supply to the heating element to stabilize the sampling value of the thermal property of the heating element to a target value;
- obtain an output power of the heating element; and
- issue a prompt when the output power is less than a preset power threshold to prompt a user that dry burning occurs in the heating element.

The prompt to be issued when the output power is less than the preset power threshold may be specifically issued by voice, light, or in other manners.

In an embodiment, the circuit is further configured to: after the step of obtaining the sampling value of the thermal property of the heating element in real time, determine, according to the sampling value obtained at a current moment, whether the heating element reaches a thermal balance state; and set the determining threshold as a first threshold if the heating element reaches the thermal balance state, where the first threshold is greater than a thermal balance stabilization value, and the thermal balance stabilization value is a thermal property value of the heating element in the thermal balance state; or set the determining threshold as a second threshold if the heating element does not reach the thermal balance state, where the second threshold is a thermal property maximum value of the heating element, and the thermal property maximum value is a thermal property value of the heating element at a preset maximum safety temperature.

In an embodiment, the circuit is further configured to:

obtain, based on the current moment, each sampling value within first duration ending at the current moment, where the first duration includes the current moment; and if each sampling value within the first duration complies with a preset rule, determine that the heating element reaches the thermal balance state.

In an embodiment, the preset rule is:

a difference between the largest value and the smallest value among the sampling values within the first duration falls within a preset difference range. In an embodiment, the circuit is further configured to:

when the sampling value exceeds the determining threshold, obtain a heating time corresponding to when the sampling value exceeds the determining threshold.

In an embodiment, the circuit is further configured to:

if the heating time is greater than a preset continuous heating time, set the target value to be greater than the thermal balance stabilization value. In an embodiment, the circuit is further configured to:

if the heating time is less than a preset continuous heating time and the heating element has reached the thermal balance state, set the target value to be less than or equal to the thermal balance stabilization value.

In an embodiment, the circuit is further configured to:

if the heating time is less than a preset continuous heating time and the heating element has not reached the thermal balance state, set the target value to be equal to the thermal property maximum value.

In an embodiment, the circuit is further configured to: obtain an initial sampling value of the heating element; and determine a thermal property maximum value according to the initial sampling value and a preset maximum safety temperature.

For a specific limitation on the aerosol generation device, refer to the limitation on the dry burning detection method above. Details are not described herein again.

In an embodiment, an aerosol generation device is provided, including a heater, a power supply, and a circuit. The heater includes at least one heating element configured to heat an aerosol-forming substrate. The circuit includes a memory and one or more processors. The memory stores computer-readable instructions. The computer-readable instructions, when executed by the one or more processors, cause the one or more processors to perform the following steps:

obtaining a sampling value of a thermal property of a heating element in real time;

when the sampling value exceeds a preset determining threshold, controlling the sampling value of the thermal property of the heating element to be stabilized to a target value; obtaining an output power of the heating element; and issuing a prompt when the output power is less than a preset power threshold to prompt a user that dry burning occurs in the heating element. In an embodiment, when the processor executes the computer-readable instructions, the following steps are further implemented:

determining, according to the sampling value obtained at a current moment, whether the heating element reaches a thermal balance state; and setting the determining threshold as a first threshold if the heating element reaches the thermal balance state, where the first threshold is greater than a thermal balance stabilization value, and the thermal balance stabilization value is a thermal property value of the heating element in the thermal balance state; or setting the determining threshold as a second threshold if the heating element does not reach the thermal balance state, where the second threshold is a thermal property maximum value of the heating element, and the thermal property maximum value is a thermal property value of the heating element at a preset maximum safety temperature.

In an embodiment, when the processor executes the computer-readable instructions, the following steps are further implemented:

obtaining, based on the current moment, each sampling value within first duration ending at the current moment, where the first duration includes the current moment; and if each sampling value within the first duration complies with a preset rule, determining that the heating element reaches the thermal balance state. In an embodiment, when the processor executes the computer-readable instructions, the following step is further implemented:

when the sampling value exceeds the determining threshold, obtaining a heating time corresponding to when the sampling value exceeds the determining threshold. In an embodiment, when the processor executes the computer-readable instructions, the following step is further implemented:

if the heating time is greater than a preset continuous heating time, setting the target value to be greater than the thermal balance stabilization value.

In an embodiment, when the processor executes the computer-readable instructions, the following step is further implemented:

if the heating time is less than a preset continuous heating time and the heating element has reached the thermal balance state, setting the target value to be less than or equal to the thermal balance stabilization value.

In an embodiment, when the processor executes the computer-readable instructions, the following step is further implemented:

if the heating time is less than a preset continuous heating time and the heating element has not reached the thermal balance state, setting the target value to be equal to the thermal property maximum value.

In an embodiment, when the processor executes the computer-readable instructions, the following steps are further implemented:

obtaining an initial sampling value of the heating element; and determining a thermal property maximum value according to the initial sampling value and a preset maximum safety temperature.

A computer program product is provided, including one or more computer-readable storage mediums storing computer-readable instructions. The computer-readable instructions, when executed by one or more processors, cause the one or more processors to perform the following steps:

obtaining a sampling value of a thermal property of a heating element in real time;

when the sampling value exceeds a preset determining threshold, controlling the sampling value of the thermal property of the heating element to be stabilized to a target value;

obtaining an output power of the heating element; and issuing a prompt when the output power is less than a preset power threshold to prompt a user that dry burning occurs in the heating element. In an embodiment, when the computer-readable instructions are executed by the processor, the following steps are further implemented:

determining, according to the sampling value obtained at a current moment, whether the heating element reaches a thermal balance state; and setting the determining threshold as a first threshold if the heating element reaches the thermal balance state, where the first threshold is greater than a thermal balance stabilization value, and the thermal balance stabilization value is a thermal property value of the heating element in the thermal balance state; or setting the determining threshold as a second threshold if the heating element does not reach the thermal balance state, where the second threshold is a thermal property maximum value of the heating element, and the thermal property maximum value is a thermal property value of the heating element at a preset maximum safety temperature.

In an embodiment, when the computer-readable instructions are executed by the processor, the following steps are further implemented:

obtaining, based on the current moment, each sampling value within first duration ending at the current moment, where the first duration includes the current moment; and if each sampling value within the first duration complies with a preset rule, determining that the heating element reaches the thermal balance state. In an embodiment, when the computer-readable instructions are executed by the processor, the following step is further implemented:

when the sampling value exceeds the determining threshold, obtaining a heating time corresponding to when the sampling value exceeds the determining threshold. In an embodiment, when the computer-readable instructions are executed by the processor, the following step is further implemented:

if the heating time is greater than a preset continuous heating time, setting the target value to be greater than the thermal balance stabilization value. In an embodiment, when the computer-readable instructions are executed by the processor, the following step is further implemented:

if the heating time is less than a preset continuous heating time and the heating element has reached the thermal balance state, setting the target value to be less than or equal to the thermal balance stabilization value.

In an embodiment, when the computer-readable instructions are executed by the processor, the following step is further implemented:

if the heating time is less than a preset continuous heating time and the heating element has not reached the thermal balance state, setting the target value to be equal to the thermal property maximum value.

In an embodiment, when the computer-readable instructions are executed by the processor, the following steps are further implemented: obtaining an initial sampling value of the heating element; and determining a thermal property maximum value according to the initial sampling value and a preset maximum safety temperature.

A person of ordinary skill in the art may understand that all or some of the procedures of the method in the foregoing embodiments may be implemented by computer-readable instructions instructing relevant hardware. The computer-readable instructions may be stored in a non-volatile computer-readable storage medium. When the computer-readable instructions are executed, the procedures of the foregoing method embodiments may be implemented. Any reference to a memory, storage, database, or other mediums used in the embodiments provided in this application may include a non-volatile and/or volatile memory. The non-volatile memory may include a read-only memory (ROM), a programmable ROM (PROM), an electrically programmable ROM (EPROM), an electrically erasable programmable ROM (EEPROM), or a flash memory. The volatile memory may include a random access memory (RAM) or an external cache. By way of description rather than limitation, the RAM may be obtained in multiple forms, such as a static RAM (SRAM), a dynamic RAM (DRAM), a synchronous DRAM (SDRAM), a double data rate SDRAM (DDRS-DRAM), an enhanced SDRAM (ESDRAM), a synchlink (Synchlink) DRAM (SLDRAM), a rambus (Rambus) direct RAM (RDRAM), a direct rambus dynamic RAM (DRDRAM), and a rambus dynamic RAM (RDRAM).

The technical features of the foregoing embodiments may be randomly combined. For brevity of description, not all possible combinations of the technical features in the foregoing embodiments are described. However, the combinations of these technical features should be considered as falling within the scope of this specification as long as no contradiction occurs.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. An aerosol generation device, comprising:

a heater comprising at least one heating element configured to heat an aerosol-forming substrate;

a power supply; and a circuit, connected to the heater and the power supply, the circuit being configured to:

obtain a sampling value of a thermal property of the at least one heating element in real time;

when the sampling value exceeds a preset determining threshold, control power supplied by the power supply to the at least one heating element to stabilize the sampling value of the thermal property of the at least one heating element to a target value;

obtain an output power of the at least one heating element; and issue a prompt when the output power is less than a preset power threshold to prompt a user that dry burning occurs in the at least one heating element, wherein the circuit is further configured after obtaining the sampling value of the thermal property of the at least one heating element in real time, to:

determine, according to the sampling value obtained at a current moment, whether the at least one heating element reaches a thermal balance state; and set the determining threshold as a first threshold if the at least one heating element reaches the thermal balance state, the first threshold being greater than a thermal balance stabilization value, and the thermal balance stabilization value being a thermal property value of the at least one heating element in the thermal balance state; or set the determining threshold as a second threshold if the at least one heating element does not reach the thermal balance state, the second threshold being a thermal property maximum value of the at least one heating element, and the thermal property maximum value being a thermal property value of the at least one heating element at a preset maximum safety temperature.

2. The aerosol generation device of claim 1, wherein the circuit is configured to:

obtain, based on the current moment, each sampling value within first duration ending at the current moment, the first duration comprising the current moment; and if each sampling value within the first duration complies with a preset rule, determine that the at least one heating element reaches the thermal balance state.

3. The aerosol generation device of claim 2, wherein the preset rule comprises a difference between a largest value and a smallest value among the sampling values within the first duration falls within a preset difference range.

4. The aerosol generation device of claim 1, wherein the circuit is configured to:

when the sampling value exceeds the determining threshold, obtain a heating time corresponding to when the sampling value exceeds the determining threshold.

5. The aerosol generation device of claim 4, wherein the circuit is configured to:

if the heating time is greater than a preset continuous heating time, set the target value to be greater than the thermal balance stabilization value.

6. The aerosol generation device of claim 4, wherein the circuit is configured to:

if the heating time is less than a preset continuous heating time and the at least one heating element has reached the thermal balance state, set the target value to be less than or equal to the thermal balance stabilization value.

7. The aerosol generation device of claim 4, wherein the circuit is configured to:

if the heating time is less than a preset continuous heating time and the at least one heating element has not reached the thermal balance state, set the target value to be equal to the thermal property maximum value.

8. The aerosol generation device of claim 1, wherein the circuit is configured to:

obtain an initial sampling value of the at least one heating element; and determine a thermal property maximum value according to the initial sampling value and a preset maximum safety temperature.

9. A dry burning detection method, comprising:

obtaining a sampling value of a thermal property of a heating element in real time;

when the sampling value exceeds a preset determining threshold, controlling the sampling value of the thermal property of the heating element to be stabilized to a target value;

obtaining an output power of the heating element; and issuing a prompt when the output power is less than a preset power threshold to prompt a user that dry burning occurs in the heating element, wherein, after the obtaining the sampling value of the thermal property of the heating element in real time, the method comprises:

determining, according to the sampling value obtained at a current moment, whether the heating element reaches a thermal balance state; and setting the determining threshold as a first threshold if the heating element reaches the thermal balance state, the first threshold being greater than a thermal balance stabilization value, and the thermal balance stabilization value being a thermal property value of the heating element in the thermal balance state; or setting the determining threshold as a second threshold if the heating element does not reach the thermal balance state, the second threshold being a thermal property maximum value of the heating element, and the thermal property maximum value being a thermal property value of the heating element at a preset maximum safety temperature.

10. The dry burning detection method of claim 9, wherein, when the sampling value exceeds the preset determining threshold, the method comprises:

obtaining a heating time corresponding to when the sampling value exceeds the determining threshold.

11. The dry burning detection method of claim 10, wherein, if the heating time is greater than a preset continuous heating time, the target value is a preset sampling value, and the preset sampling value is greater than the thermal balance stabilization value.

12. The dry burning detection method of claim 10, wherein, if the heating time is less than a preset continuous heating time and the heating element has reached the thermal balance state, the target value is less than or equal to the thermal balance stabilization value.

13. The dry burning detection method of claim 10, wherein, if the heating time is less than a preset continuous heating time and the heating element has not reached the thermal balance state, the target value is equal to the thermal property maximum value.

14. One or more non-transitory computer-readable mediums having processor-executable instructions stored thereon, wherein the processor-executable instructions, when executed, facilitate a method, comprising:

obtaining a sampling value of a thermal property of a heating element in real time;

when the sampling value exceeds a preset determining threshold, controlling the sampling value of the thermal property of the heating element to be stabilized to a target value;

obtaining an output power of the heating element; and issuing a prompt when the output power is less than a preset power threshold to prompt a user that dry burning occurs in the heating element, wherein the method further comprises:

determining, according to the sampling value obtained at a current moment, whether the heating element reaches a thermal balance state; and setting the determining threshold as a first threshold if the heating element reaches the thermal balance state, the first threshold being greater than a thermal balance stabilization value, and the thermal balance stabilization value being a thermal property value of the heating element in the thermal balance state; or setting the determining threshold as a second threshold if the heating element does not reach the thermal balance state, the second threshold being a thermal property maximum value of the heating element, and the thermal property maximum value being a thermal property value of the heating element at a preset maximum safety temperature.

15. The one or more non-transitory computer-readable mediums of claim 14, wherein, when the processor-executable instructions are executed, the method comprises:

obtaining a heating time corresponding to when the sampling value exceeds the determining threshold.

16. The one or more non-transitory computer-readable mediums of claim 15, wherein, when the processor-executable instructions are executed, the method comprises:

if the heating time is greater than a preset continuous heating time, setting the target value to be greater than thermal balance stabilization value.

17. The one or more non-transitory computer-readable mediums of claim 15, wherein, when the processor-executable instructions are executed, the method comprises:

if the heating time is less than a preset continuous heating time and the heating element has reached the thermal balance state, setting the target value to be less than or equal to the thermal balance stabilization value.

18. The dry burning detection method of claim 9, further comprising:

obtaining, based on the current moment, each sampling value within first duration ending at the current moment, the first duration comprising the current moment; and if each sampling value within the first duration complies with a preset rule, determining that the at least one heating element reaches the thermal balance state.

19. The dry burning detection method of claim 18, wherein the preset rule comprises a difference between a largest value and a smallest value among the sampling values within the first duration falls within a preset difference range.

20. The one or more non-transitory computer-readable mediums of claim 15, wherein, when the processor-executable instructions are executed, the method comprises:

if the heating time is less than a preset continuous heating time and the heating element has reached the thermal balance state, setting the target value to be equal to the thermal property maximum value.

* * * * *